US007328779B2

(12) United States Patent
King et al.

(10) Patent No.: US 7,328,779 B2
(45) Date of Patent: Feb. 12, 2008

(54) RATCHET COMPRESSOR FOR EXPANDABLE LUGGAGE

(75) Inventors: William L. King, Warren, RI (US); Glenn Schmierer, Golden, CO (US)

(73) Assignee: Samsonite Corporation, Mansfield, MA (US)

( * ) Notice: Subject to any disclaimer, the term of this patent is extended or adjusted under 35 U.S.C. 154(b) by 0 days.

(21) Appl. No.: 11/041,915

(22) Filed: Jan. 25, 2005

(65) Prior Publication Data

US 2006/0070837 A1 Apr. 6, 2006

Related U.S. Application Data

(60) Provisional application No. 60/616,377, filed on Oct. 6, 2004.

(51) Int. Cl.
*A45C 7/00* (2006.01)

(52) U.S. Cl. ..... 190/105; 190/104

(58) Field of Classification Search ..... 190/104, 190/105, 103, 106
See application file for complete search history.

(56) References Cited

U.S. PATENT DOCUMENTS 440,278 A * 11/1890 Payntar ..... 190/105
712,762 A * 11/1902 Bukoutz ..... 190/105
852,300 A * 4/1907 Schoenborn ..... 190/105
1,241,210 A * 9/1917 Harvey ..... 190/104
1,646,092 A * 10/1927 Hawes et al. ..... 190/104
4,844,215 A * 7/1989 Ambasz ..... 190/105
6,305,513 B1 * 10/2001 Lu ..... 190/103
6,390,259 B1 * 5/2002 Lu ..... 190/103
6,575,272 B1 * 6/2003 Krulik et al. ..... 190/103
2002/0040834 A1 * 4/2002 Chen ..... 190/103

* cited by examiner

*Primary Examiner*—Tri M. Mai

(57) ABSTRACT

Disclosed is a method and system for compressing and automatically expanding an expandable luggage case 2 comprising a ratchet mechanism 8 and a bungee cord 32, that is used to bias a locking mechanism, in the form of detents 54 that mate with teeth 44, in a locked position, and to bias a jack mechanism 14 for automatic expansion. The bungee cord 32 biases the ratchet compressor system 8 in an expanded state. Thus, automatic expansion is achieved, in a very easy to use manner. In addition to being operated while the luggage case 2 is open, the ratchet compressor 8 is also operable from the outside of the luggage case 2 once the luggage case 2 has been packed and closed. A user may then compress the luggage case 2 simply by applying pressure to the lid 24. The ratchet compressor system 8 therefore provides a zipper-less, automated method of expanding a luggage case 2 as well as compressing the luggage case 2 once the luggage case 2 has been closed.

5 Claims, 7 Drawing Sheets

RATCHET COMPRESSOR FOR EXPANDABLE LUGGAGE

CROSS-REFERENCE TO RELATED APPLICATION

This application claims the benefit of U.S. Provisional Application No. 60/616,377 filed on Oct. 6, 2004. The above-identified application is hereby incorporated by reference as if fully disclosed herein.

BACKGROUND OF THE INVENTION

This invention relates to luggage. More particularly, this invention relates to a method and system that allows a user to both automatically expand an expandable luggage case, without the use of a zipper or zippered gusset, and to easily compress the luggage case once it has been packed, closed, and locked, by providing a multitude of intermediate locking positions.

In the past, efforts have been made to provide luggage with expansive and compressive characteristics for a user's convenience. One can take interest in U.S. Pat. No. 712,762 by M. Bukoutz entitled "Telescopic Traveling Bag", in which a knob and a complicated mechanical mechanism provide a telescoping traveling case. The expansion and compression of the traveling case is achieved by manual rotation of the knob and thus requires a substantial effort by the user. The operation of the mechanism is entirely manual, and a series of hinges, bars, and ratchets makes the mechanism sensitive to malfunction and wear. Furthermore, by providing only one central operator, the device disclosed in the Bukoutz patent lacks locking protection against bumps, falls, and other misuse and abuse of the luggage case, which may result in the unexpected release of the mechanism or opening of the luggage case.

In more recent times, expansive and compressive techniques have frequently included providing a gusset with a peripheral zipper between a main packing compartment and an auxiliary body having a lid. Such current techniques usually involve soft shell luggage cases. Other luggage cases include a stiffening device that is attached to the gusset that is operated manually by a user from the inside of the main packing compartment. The stiffening component may provide means for extending upwardly (or outwardly, depending on a user's vantage point) a gusset by operating a control mechanism attached to the stiffening portion from the inside of the packing compartment. There are currently no luggage cases available on the market that provide a system and method for compressing the luggage case and its contained clothing once the lid of the luggage case has been securely closed. Furthermore, many such attempts have failed to recognize a need for providing multiple stages of compression.

A need therefore exists for an adjustable, easy to use system that provides expansion and compression of a luggage case. It would be beneficial for such a system to be operable from the outside of the case when the case has been packed, closed and locked. A need also exists for an automated system of expanding a suitcase. A need further exists for multiple secure stages of closure by providing intermediate locked positions. A device is needed to provide compression and expansion to not only soft shell luggage cases but also luggage cases of all types, shapes and sizes including hard shell luggage cases. It would beneficial to have a compression/expansion system that provides audible feedback to the user, as well as safety features such as two opposed latching mechanisms to help prevent against unwanted expanding of the suitcase. All of these features are needed in luggage case that does not rely on a zipper to provide expansion or compression of the suitcase. Furthermore, a need exists for a mechanism that accomplishes all of these goals in a simple, low friction, and durable manner that consists of a minimal number of parts to be added to a standard luggage case.

BRIEF SUMMARY OF THE INVENTION

These goals have been achieved by the present invention, which provides a system and method that creates compression and automatic expansion of a luggage case while also supplying a number of intermediate, secure positions between a fully compressed position and a fully expanded position. The term "luggage" herein is meant to include all types of storage and/or transport vessels including large storage containers such as molded plastic storage and shipping boxes for linens and the like, briefcases, computer bags, messenger bags, backpacks, etc. The present invention accomplishes these goals by using a spring, which in the preferred embodiment is in the form of a loop of bungee cord. The bungee cord pushes a gusset portion, of an expandable luggage case that is in a compressed condition, upward to force the expansion of the luggage case when a ratchet compressor mechanism, which is normally locked in a degree of compression, is released.

The bungee cord is fixedly attached to a base plate of the ratchet compressor, which is fixed to the sidewall of the main packing compartment of the luggage case. The bungee cord is pulled by a slidably movable jack that has teeth that mate with the corresponding base plate. To maintain a locked state, the bungee cord biases a pair of detents whose end portions comprise hooks that engage these teeth. In its fully extended state, the jack provides full expansion of the luggage case by extending the gusset to its full width. A lid of the luggage case may also be sewn to the top portion of the gusset, thereby eliminating superfluous parts in order to achieve expansion of the luggage case. The bungee cord is normally tensioned and applies a strong pushing force, that is created by a system of pulleys that are journaled to the base plate, to a tongue located on the jack. As tension within the bungee cord is created when the jack is fully or even partially depressed, the bungee cord biases the releasable detents to engage the tooth portions of the jack. A novel aspect of the present invention is this dual biasing action provided by the bungee cord. That is, not only does the bungee cord bias the jack towards a fully extended position, thereby automatically creating full expansion of a luggage case, but the bungee cord also provides a bias to the detents so that the entire ratchet compressor mechanism can maintain a locked state in a multitude of intermediate positions between full depression of the jack (and therefore full compression of the luggage case) and full extension of the jack (full expansion of the luggage case).

Accordingly, to operate the ratchet compressor system, a user squeezes grip portions of the detents. This action releases the jack and thereby expands the luggage case to its full packing capacity prior to loading the luggage case with clothes, personal items, etc. Once the luggage case has been packed according to the needs of the user, the user merely closes the lid. Of course, if the luggage case is a soft-shell case, the lid may be closed by a zipper; conversely, a hard shell luggage case may be snapped shut. Notably, the ratchet compressor 8 can be applied to hard shell and soft shell luggage cases. A gusset could comprise any material that is suited for an expandable/contractible (and therefore perhaps an accordion-type) motion. The gusset could comprise metal, plastic, fabric, or any material so suited with hinges and pins to achieve such an accordion action. Thus, a hard shell or soft shell luggage case comprising a gusset of either flexible or rigid material could enjoy the benefits of the present invention. Once the luggage case is closed and perhaps locked, the user need simply push down on the lid of the luggage case with a small amount of force to achieve a desired degree of compression. A benefit of the present invention is space conservation, which becomes very useful when trying to meet carry-on size restrictions for air travel. Another benefit of compressing the luggage case to a point where no wasted space exists, is that packed items, such as clothes, remain secure, and are less likely to be wrinkled. Of course, as the user pushes down on the lid of the luggage case, the bungee cord of the present invention is tensioned. When the luggage case has been compressed a desired amount, the user stops pushing on the lid and the system becomes locked in place by the detents.

An advantage of the present invention is the spring biasing action of the bungee cord to automatically expand the luggage case to a degree of expansion. Furthermore, the luggage case need not be expanded prior to packing. As a user packs clothes and desires more space, the user may simply expand the luggage case to the required position. This provides a luggage case that is "just right" for a particular packing method.

DETAILED DESCRIPTION OF THE PREFERRED EMBODIMENT

Figure 1:
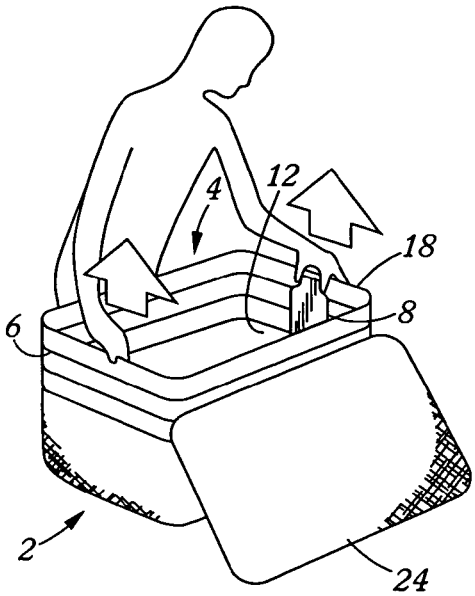
FIG. 1 illustrates a luggage case in a fully expanded position with the lid open, ready to be packed.

Referring to FIG. 1, a hard or soft shell luggage case 2 of generally known construction is being packed by a user who is packing the main packing compartment 4.

The luggage case 2 comprises a gusset 6. The main packing compartment 4 includes ratchet compressor 8. The ratchet compressor 8 includes two portions that are attached to the luggage case 2. A base plate 10 is fixedly attached to a gusset sidewall 18, within the main packing compartment 4, near an upper portion of expandable gusset 6. A jack 14, which slidably moves within base plate 10, is attached, via a bottom portion 16, to a lower portion of a sidewall 12 within main packing compartment 4. Jack 14 and base plate 10 are affixed respectively to the sidewall 12 and sidewall 18 via traditional fasteners 25. Such fasteners 25 could include screws, machine screws, bolts, rivets, pins, etc. The fasteners 25 pass through screw holes 28. Of course, it should be understood by one of ordinary skill in the art that the base plate 10 and the jack 14 could be mounted in an opposite orientation relative to the suitcase; that is, the base plate 10 could be mounted on the sidewall 18, while the jack 14 could be mounted on the gusset 6.

Figure 2:
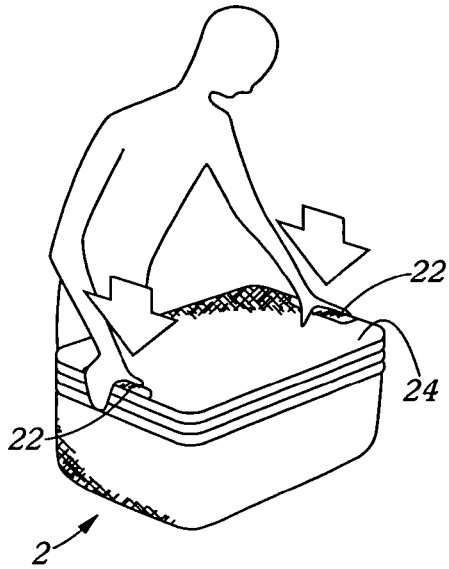
FIG. 2 is an illustration of the same luggage case shown in FIG. 1, which has been closed and compressed.
Figure 3:
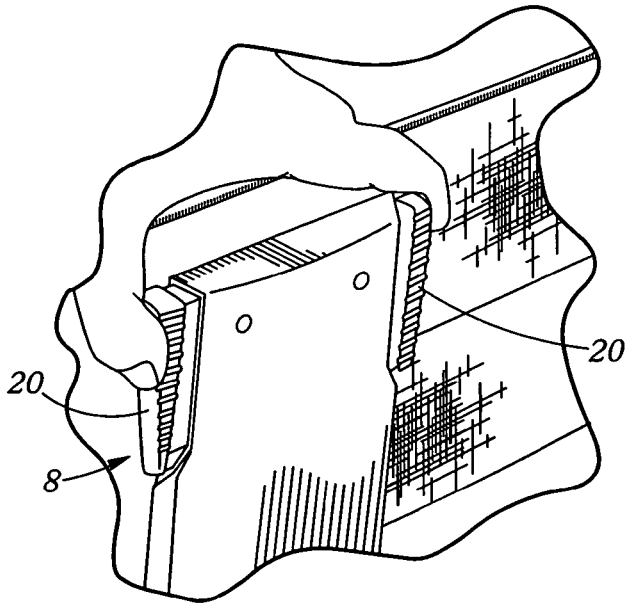
FIG. 3 shows a partial view from the inside of the luggage case of the present invention, including the detents.

Referring to FIG. 3, a user may squeeze detents 20 located on ratchet compressor 8. This motion creates expansion of luggage case 2. After luggage case 2 has been packed, the user may compress the luggage case 2 to a desired size. As illustrated in FIG. 2, compression is achieved by pushing downward on a lid 24 of luggage case 2. In essence, compression is achieved by depressing the once extended jack 14 into the base plate 10. An important feature of the present invention is an indicator 22 of the location of the diametrically opposed ratchet compressors 8. These indicators 22 may comprise pads, or any other sort of visual differentiation from the texture, color, or pattern of the rest of the material of the lid 24. For example, pads 22 may comprise a slightly bulbous shape or may have a smoother or rougher texture in comparison to the texture of the rest of the lid 24. In this way, pads could be used to provide grip for easy lifting of luggage case 2. Another innovation of the pads 22 is to provide notification to a user that luggage case 2 is special and unique. FIGS. 1 and 2 depict two oppositely positioned ratchet compressors 8. Of course, the location, size, color, overall shape and design as well as the number of ratchet compressors 8 can vary depending upon the use, shape and size of the tote bag. For example, luggage case 2 may have one centrally located ratchet compressor 8. Alternatively, the ratchet compressors 8 may be placed in a diagonal fashion, a non-symmetrical fashion, or placed in the corners of luggage case 2.

Figure 4:
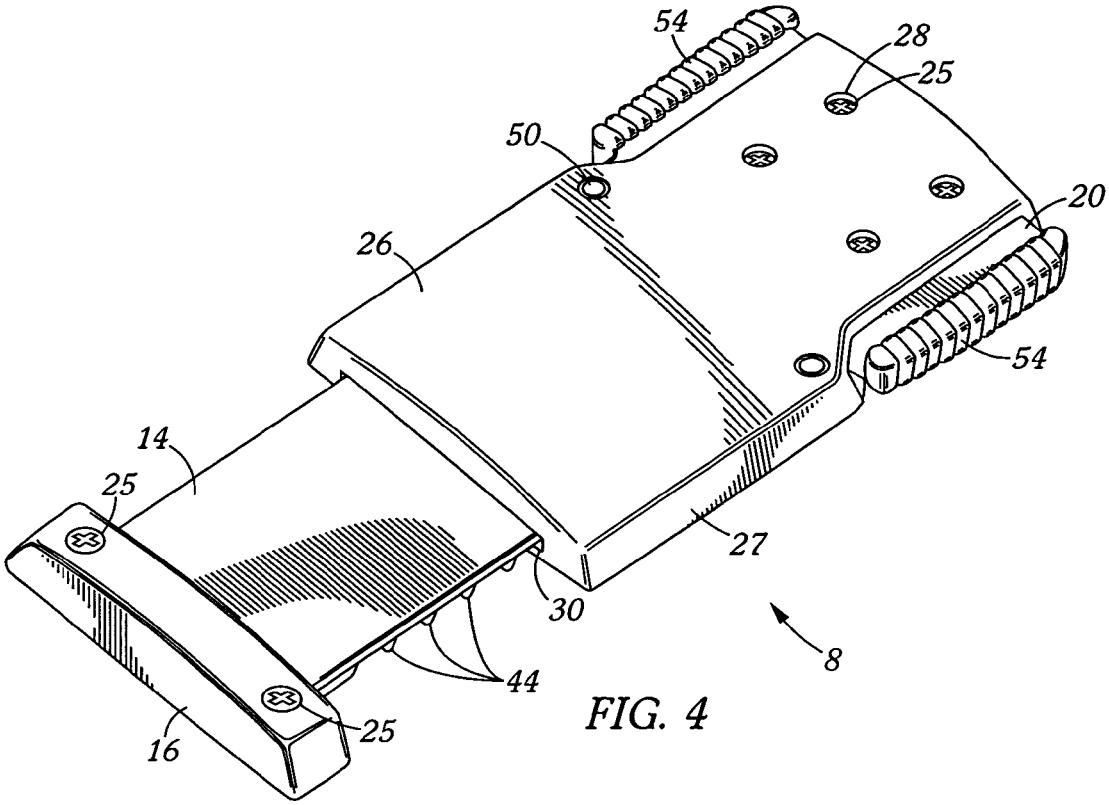
FIG. 4 is a perspective view of the preferred embodiment of the present invention as shown from the inside of the luggage case.
Figure 5:
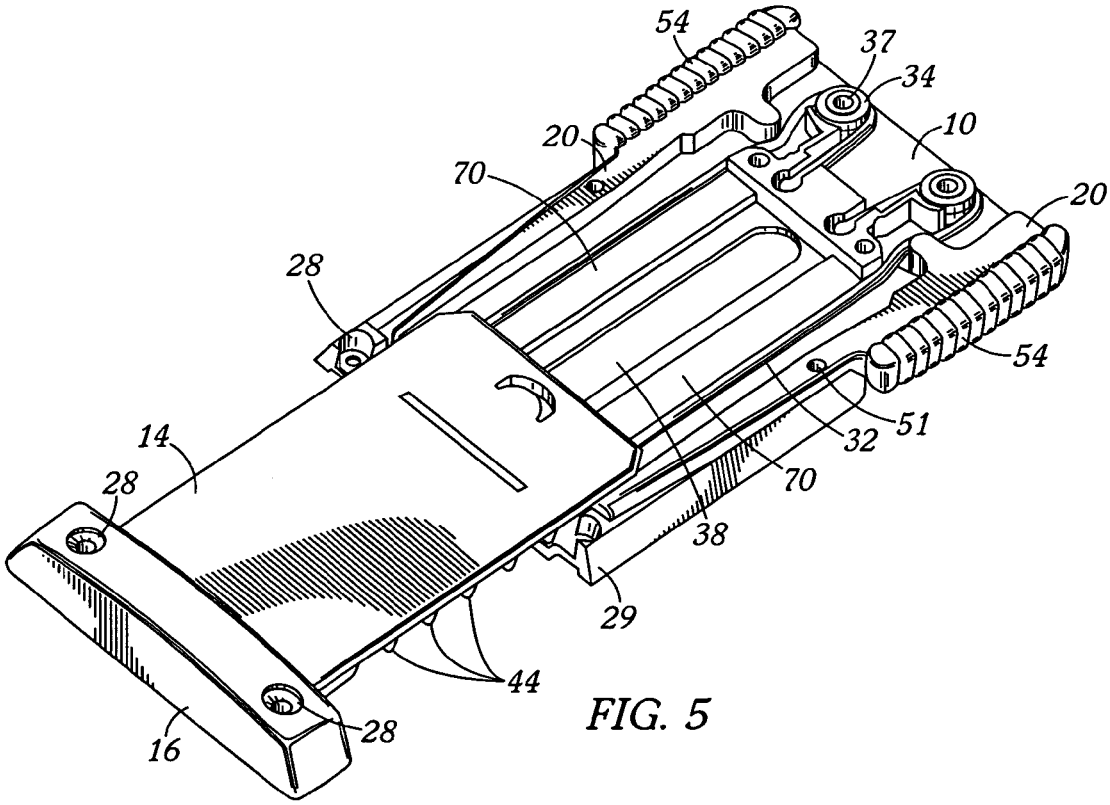
FIG. 5 is a view of the preferred embodiment of the present invention with the cover plate removed.
Figure 5B:
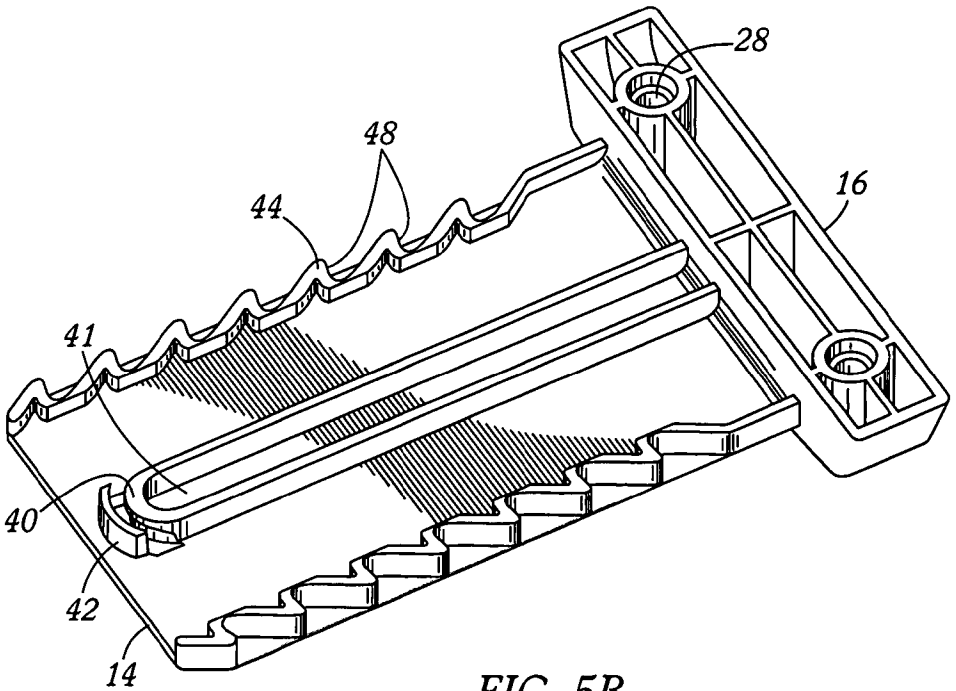
FIG. 5B is a perspective bottom view of the preferred embodiment of the jack.
Figure 5A:
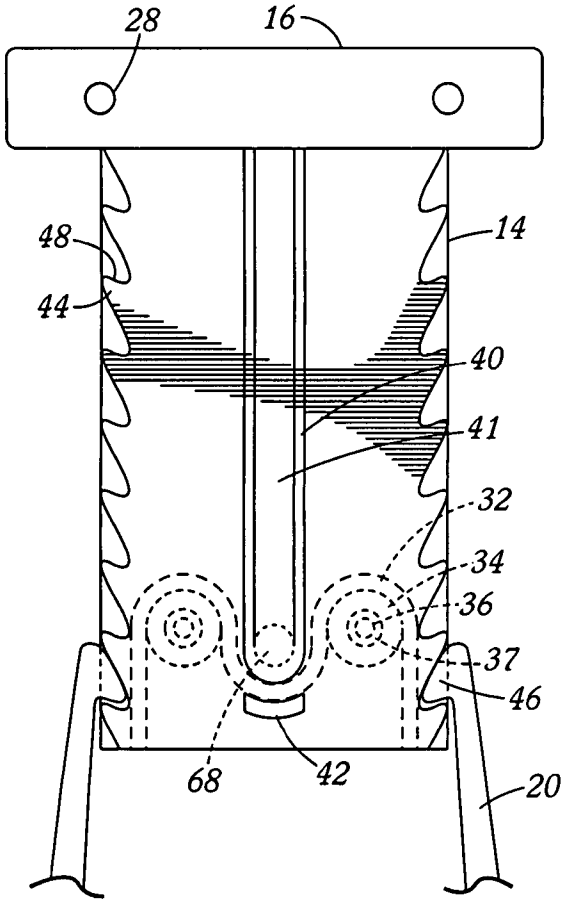
FIG. 5A is a bottom view of the preferred embodiment of the jack including the detents, bungee cord, and stopper.

Referring to FIG. 4, ratchet compressor 8 is shown with a cover plate 26. Cover plate 26 is fixedly attached to base plate 10 via fasteners 25. Fasteners 25 protrude through screw holes 28. Fasteners 25 can be of any suitable type including conventional rivets or screws. Jack 14 slides between a slot 30 provided by base plate 10 and cover plate 26. Cover plate 26 also comprises lip 27 that provides an aesthetic appearance to the ratchet compressor 8. Base plate 10 may also comprise railing 29, which provides an aesthetically pleasing appearance to ratchet compressor 8. Shown in FIG. 5 is bungee cord 32. Bungee cord 32 remains in a tensioned state by being tightly wound around pulleys 34. Pulleys 34 rotate about hollow axles 37 that are integral with base plate 10. Posts 36, which are also integral with base plate 10, protrude through hollow axles 37. The hollow axles 37 act as bearings for pulleys 34 and as snug housings for posts 36. Base plate 10 also comprises railing 29 that serves as a support for lip 27. The components of ratchet compressor 8, including base plate 10, may comprise any material suitable for the purpose of the present invention. The components of the ratchet compressor 8 are preferably constructed of, or at least selected surfaces are coated with, a material that has a low coefficient of friction, to create a low-friction and therefore durable system. Of course, base plate 10 and other components may be constructed of any material suitable for the use of the present invention. The ratchet compressor 8 components may therefore comprise polymer, aluminum, magnesium, or any other metal, or any other material. Base plate 10 also comprises a recess 38 that houses a hollow tongue portion 40 of jack 14. Tongue 40 is integral with jack 14. Referring to FIGS. 5A and 5B, tongue 40 tensions bungee cord 32 when jack 14 is depressed into slot 30 by pushing on bungee cord 32. Also shown in FIGS. 5A and 5B is retainer 42, which is also integral with jack 14. Retainer 42 grabs bungee cord 32 when jack 14 is being extended. Thus, the combination of the tongue 40 and retainer 42 provides a push/pull action on the bungee cord 32. During expansion, a stopper 68 prevents the bungee cord 32 and jack 14 from being pulled beyond the edge of base plate 10 by butting against the extreme end of tongue 40. Stopper 68 is integral with base plate 10. Stopper 68 is of such thickness so as to fit snugly within slot 30 and is of such circumference so as to snugly slide within tongue 40, thus providing additional stability to tongue 40 and jack 14 during movement. Jack 14 also comprises teeth 44. As indicated in FIGS. 5A and 5B and as is universally known with regard to ratchet systems, movement of jack 14 in an upward motion is restricted by the configuration of the teeth 44 in relation to a hook portion 46 of detents 20.

Figure 6:
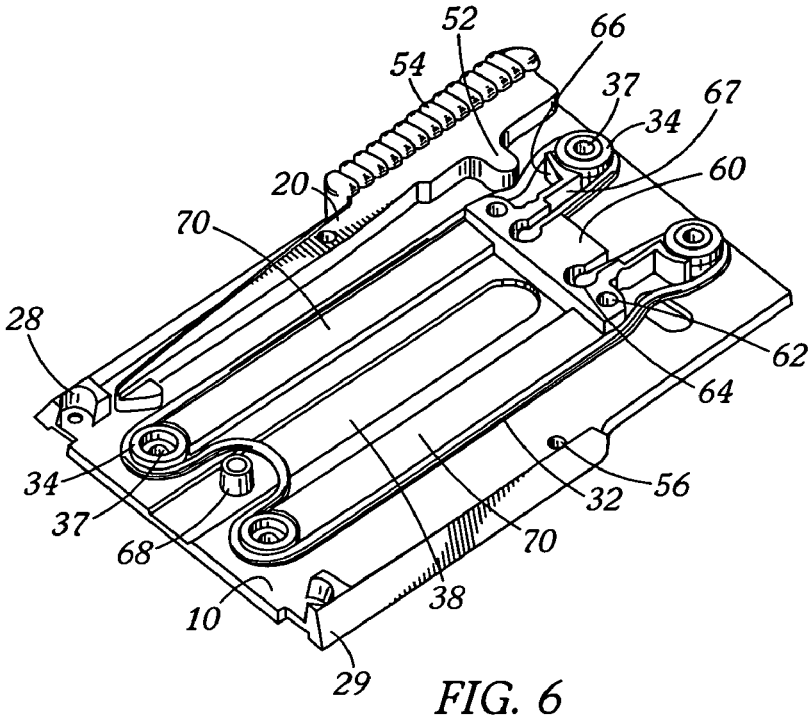
FIG. 6 is a perspective view of the preferred embodiment of the base plate with the one detent removed for clarity.
Figure 7:
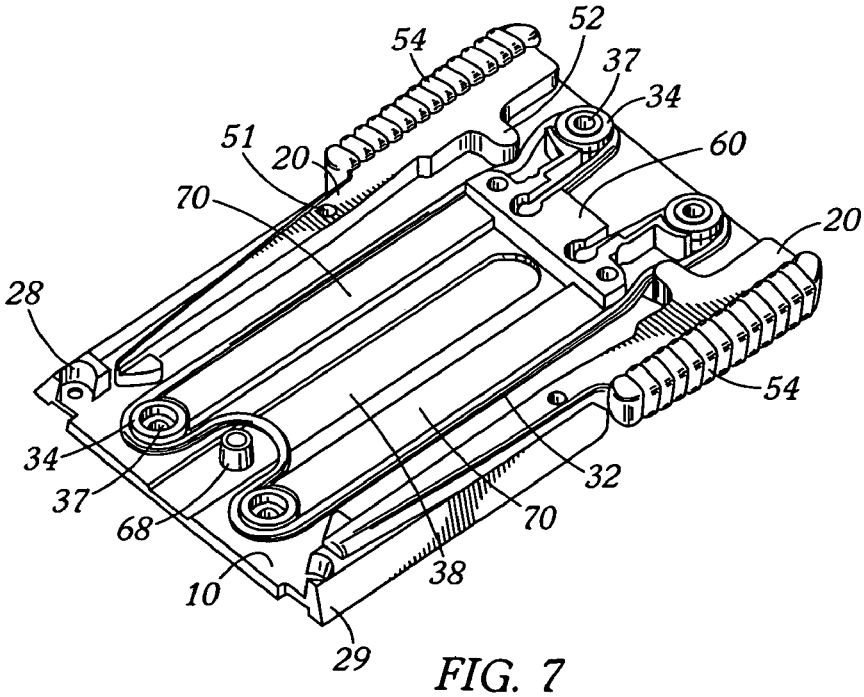
FIG. 7 is a perspective view of the same base plate shown in FIG. 6 including both detents.

As shown in FIG. 6, detent 20 comprises a long arm that pivots about a location that is approximately central to its length. Referring to FIG. 7, detents 20 each comprise a hook portion 46 that engages tooth 44 of jack 14. Hook portion 46 is engaged with tooth 44 as a result of the tension of bungee cord 32 created by pulleys 34. When jack 14 is depressed, the tension in bungee cord 32 increases, while at the same time, because of the principles of a general ratchet system, hook portions 46 are able to slide in and out of grasping surfaces 48 of teeth 44 and lock into place upon cessation of the depression of jack 14. During compression, hook portions 46 of detents 20 are able to move in and out of grasping surfaces 48 via a pivoting action. Detents 20 pivot about pivot posts 50. Pivot posts 50 are integral with base plate 10 and rotate within detent holes 51. Pivot posts 50 also freely rotate within apertures 56. Pivot posts 50 may comprise rivets that include a post that protrudes through the base plate 10, the detents 20, and the cover plate 26. Pivot posts 26 may therefore include a fixed flared head on one end and a slightly hollow opposing end to facilitate insertion of the rivet.

Conversely, detents 20 must be activated in order to extend jack 14. Detents 20 also comprise detent triggers 54 that are easy for a user to locate and depress in order activate the ratchet compressor 8 and expand luggage case 2 by extending jack 14. As the detent triggers 54 are squeezed towards one another, the ratchet compressor 8 becomes unlocked and allows jack 14 to extend thereby creating expansion of luggage case 2.

In a resting position, bungee cord 32, which is being tensioned, biases the hook portions 46 of the detents 20 in a locked position. Referring to FIGS. 6 and 7, detents 20 comprise integrated portions referred to as knobs 52. Knobs 52 are of a rectangular shape with rounded corners. When in a resting (and tensioned) position, the bungee cord 32 pushes against the knobs 52, which causes outward rotation of triggers 54 and therefore inward rotation of hook portions 46. Hook portions 46 thus by default are engaged with one of the grasping surfaces 48 on each side of the jack 14.

Figure 8:
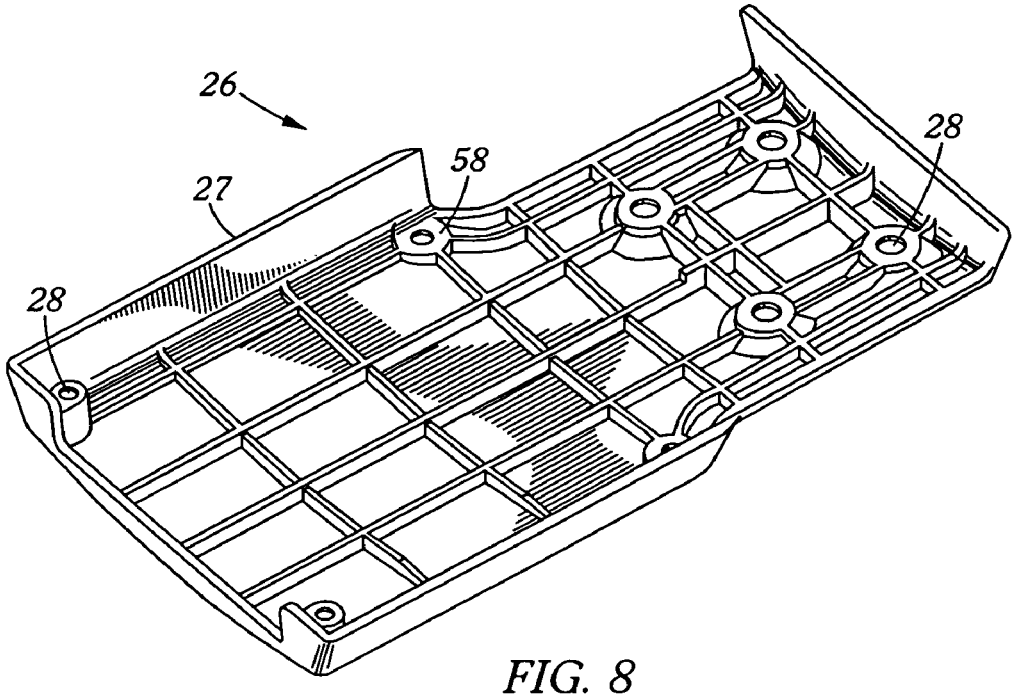
FIG. 8 is a bottom view of the preferred embodiment of the cover plate.
Figure 9:
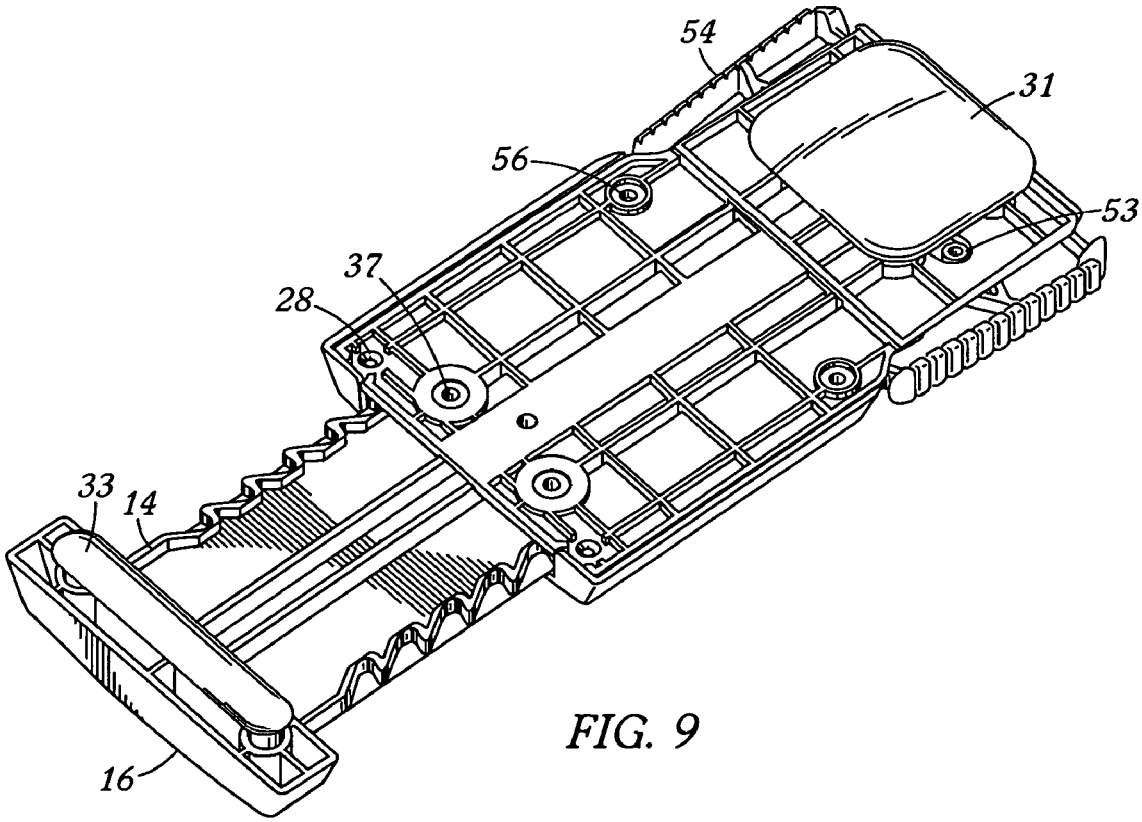
FIG. 9 is a bottom view of the preferred embodiment of the ratchet compressor including fastener receptacles.

As shown in FIGS. 5, 8 and 9, the ratchet compressor 8 consists of a multitude of molded parts. Referring to FIG. 6, apertures 56 are machined out of base plate 10 to accommodate the rotation of pivot posts 50. As shown in FIG. 8, cover plate 26 comprises hole 58, through which pivot post 50 may protrude and freely rotate. Referring to FIGS. 5, 6, and 7, base plate 10 also comprises a support 60. Support 60 may be machined or molded directly into base plate 10, and may comprise support holes 62 through which fasteners 25 may protrude to attach base plate 10 to sidewall 12. Support 60 also comprises bungee holders 64 which grasp the knotted end portions of bungee cord 32. Support 60 may also include support arcs 66, which act as a guide for pulleys 34. Support 60 also comprises indentations 67, which provide adequate space for both the normal and depressed positions of knobs 52. Support 60 is of such thickness so as to snugly fit within slot 30.

Of course, it should be understood by one of ordinary skill in the art that bungee cord 32 could be configured within ratchet compressor 8 and could be moved by jack 14 in a number of ways. For example, bungee cord 32 may comprise one continuous piece of material and could be supported by a support 60 of a circular design. As shown in FIGS. 5, 6, and 7, base plate 10 also includes guides 70 that are of a suitable dimension to provide support to cover plate 26. Guides 70 also provide longitudinal guidance to bungee cord 32 as bungee cord 32 is stretched and released. The guides 70, along with knobs 52, prevent flex of bungee cord 32. The dimensions of all components of the ratchet compressor 8, including guides 70, are such that the system moves with reliability while all components remain secure.

Figure 10:
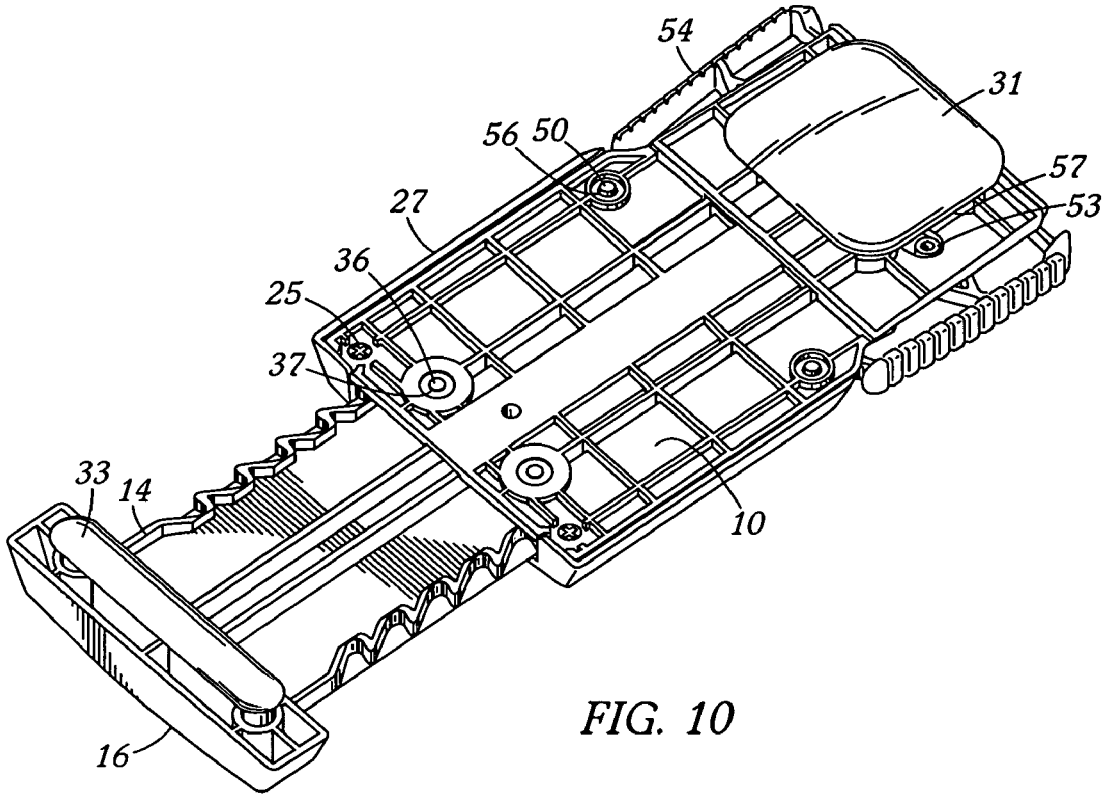
FIG. 10 is a bottom view of the preferred embodiment of the ratchet compressor including fastener receptacles and fasteners.

FIG. 8 shows the preferred embodiment of cover plate 26 from its underside. As can be seen in FIG. 8, screw holes 28 allow fasteners 25 (not shown) to connect base plate 10 to cover plate 26 and luggage case 2. Referring to FIGS. 9 and 10, a rectangular fastener receptacle 31 is used to receive the end portions of fasteners 25. Rectangular fastener receptacle 31 is fastened to the outside of luggage case 2. In this way, fasteners 25 enter the top portion of cover plate 26, protrude through the support holes 62 and the screw holes 28 of base plate 10, continue to protrude through the side-wall 12 of luggage case 2, and end in rectangular fastener receptacle 31. Rectangular fastener receptacle 31 may therefore include fastener receivers (not shown) that may be molded into the underside of rectangular fastener receptacle 31, that secure fasteners 25. For example, the fastener receivers may comprise machine bolt nuts molded into receptacle 31. In addition, the fasteners 25 could be further secured within receptacle 31 by the application of a bonding material such as Loctite®. The bottom portion 16 of jack 14 is similarly fastened to the luggage case 2 by an elongated fastener receptacle 33. Fasteners 25 enter the bottom portion 16 from a top surface thereof, protrude through the screw holes 28 of bottom portion 16, continue to protrude through side-wall 18 of gusset 6, and end in elongated fastener receptacle 33. Similarly, elongated fastener receptacle 33 may also include molded fastener receivers. Fastener receptacles 31 and 33 provide an esthetically appealing method of attaching the ratchet compressor 8 to luggage case 2.

Figure 11:
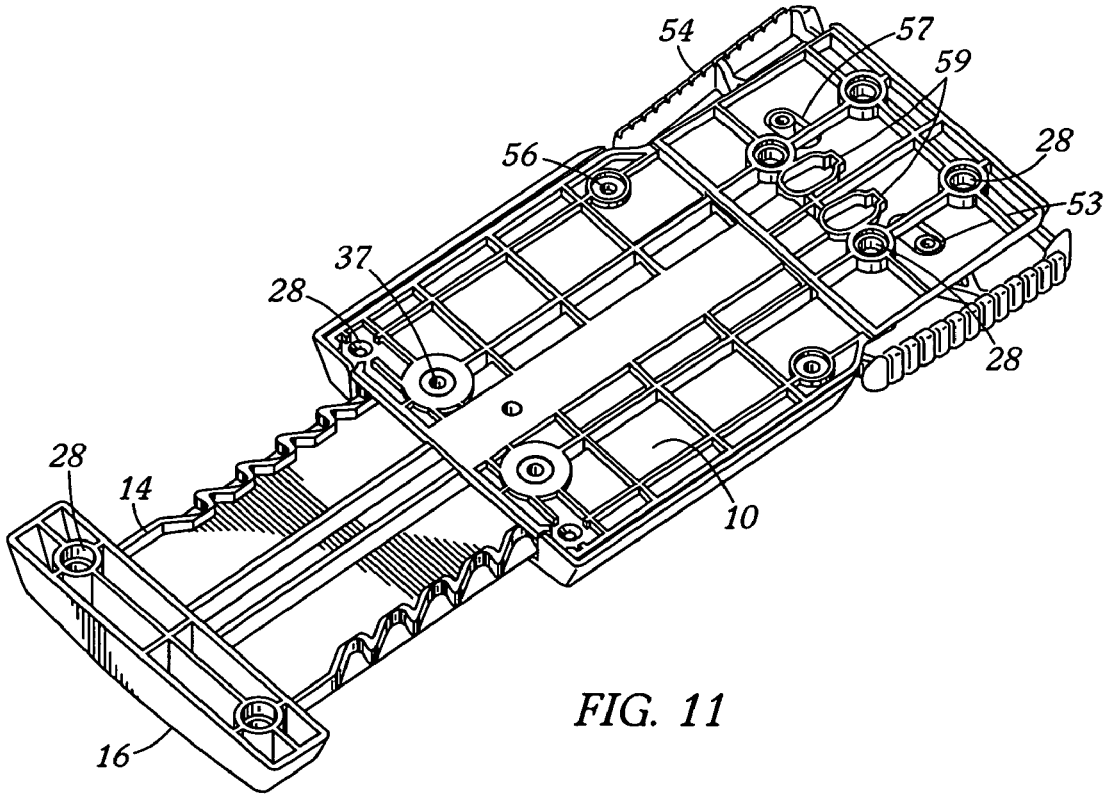
FIG. 11 is a bottom view of the preferred embodiment of the ratchet compressor without the fastener receptacles and showing spacers and spacer slits.

FIGS. 9 through 12 depict a spacer 53, that is located on knob 52, and a spacer slit 57, machined into base plate 10. Spacer 53 may comprise a circular post that protrudes upwardly from knob 52 (spacer 53 protrudes towards the inside of ratchet compressor 8) and prevents the bungee cord 32 from slipping over knob 52 upon compression of detent triggers 54. Thus, spacer 53 also provides support to cover plate 26. Spacer slit 57 may comprise a narrow slot machined into base plate 10 to accommodate spacer 53. FIG. 11 also indicates a knothole 59 that may be an open portion machined out of base plate 10 to accommodate bulbous knotted ends of bungee cord 32.

Figure 12:
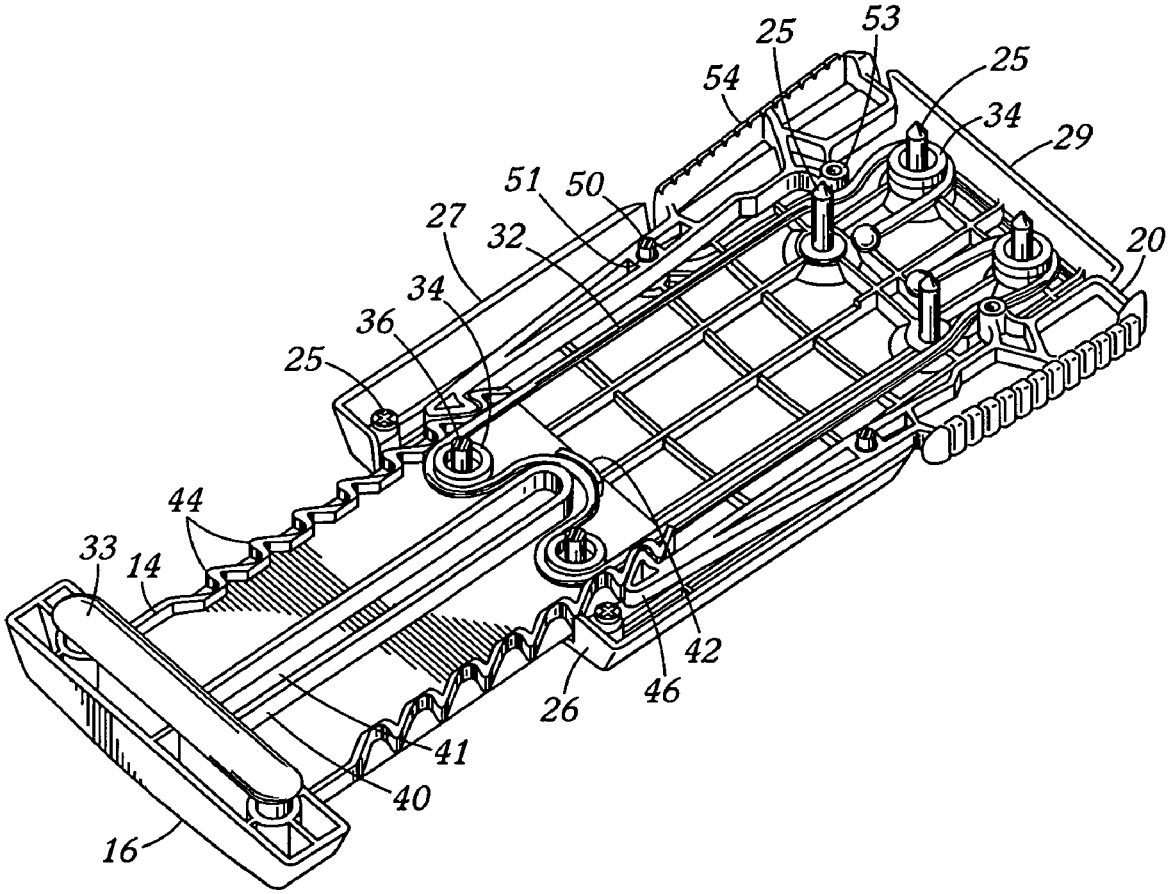
FIG. 12 is a bottom view of the preferred embodiment of the ratchet compressor showing the inner surface of the cover plate as well as the inner components of the base plate as if the base plate were transparent.

FIG. 12 illustrates the preferred embodiment of the present invention as though the base plate 10 were present but transparent, in order to facilitate viewing of the inner components attached to base plate 10. FIG. 12 includes the inner surface of cover plate 26. Thus, looking to FIG. 12 reveals fasteners 25, which protrude through the top portion of cover plate 26, continue to protrude through hollow axles 37 (not shown), and eventually terminate within rectangular fastener receptacle 31 (not shown). Shown in FIG. 12 is elongated fastener receptacle 33. Also shown are pulleys 34 and posts 36. Posts 36 are fixedly attached to base plate 10 and protrude upwardly from base plate 10 to such a height so as to snugly abut the inner surface of jack 14. Therefore posts 36 also provide support against compression (which could conceivably occur during packing of the luggage case 2) to cover plate 26.

The ratchet compressor 8 provides a zipper-less, easy to use method and system for automatically expanding and compressing a luggage case 2 or the like. The ratchet compressor 8 is applicable to all types of storage and/or transport containers including hard luggage or soft luggage. A reassuring feature of the invention is the audible "click" that is heard when the ratchet compressor 8 is compressed. Furthermore, the ratchet compressor 8 is a low friction system, one that will wear well and enjoy long life. By having more than one opposable detent 20, there is an increase in protection against bumps or other accidents which may cause accidental depression of one of the detent triggers 54 resulting in unintentional expansion of the suitcase 2. Use of a bungee cord 32 instead of a system of springs provides reliability. Of course, it should be understood by one of ordinary skill in the art that springs or other types of potential/kinetic energy systems could be used in conjunction with the present invention. The present invention is very robust and convenient due to the provision of multiple intermediate locking positions, including locking at both a fully expanded and a fully compressed state. The bungee cord 32 has two functions in that it provides a bias to the detents 20 in an engaged position so that detents 20 are normally biased to grab teeth 44 and thus remain locked. It is an advantage of the present invention that the bungee cord 32 biases the ratchet compressor 8 in the expanded position, for automatic expansion of the luggage 2. It is a very convenient feature of the present invention to provide operability from the outside of the luggage case 2.

While an otherwise conventional wheeled luggage is shown to illustrate the preferred embodiment, the inventive method and mechanism disclosed could benefit luggage cases in general, whether hard-shelled or of textile (e.g. soft-side) construction, travel bags such as backpacks, trunks, and so on, or other shipping containers.

The invention claimed is:

1. An expandable case such as a travel bag and the like having a packing compartment for receiving at least an article to be packed therein, access means for selectively opening and closing the packing compartment, a ratchet means for automatically expanding the packing compartment to a degree and for holding the case in a compressed condition once the access is closed, said ratchet means being positioned within an inner cavity of said expandable case and further includes a release mechanism that is accessible by a user only when said access is open, said ratchet means further including a slidably movable jack, said ratchet means further including a base plate that houses said slidably movable jack, wherein said jack further includes a set of teeth and slides into and out of a cavity within said base plate, said release mechanism including at least one detent that is activated by depressing said detent, said detent further including a hook portion that engages said teeth located on said jack, said ratchet means being held in a series of locked, secure positions when said hook portion engages said teeth, said ratchet means further comprising a biasing means that is engaged with said jack, said biasing means biases the jack in a fully extended position, and biases said expandable case in a fully expanded position when said detents are depressed, thus creating automatic expansion of said case.

2. The biasing means of claim 1 wherein said biasing means biases said detent to engage said hook portion thereby locking said ratchet means.

3. The ratchet means of claim 2 wherein upon compression of said case after the access has been closed, said biasing means provides a series of secure compressed positions.

4. The biasing means of claim 3 wherein said biasing means further comprises a bungee cord.

5. The biasing means of claim 4 wherein said bungee cord is tensioned by being wound tightly around a system of pulleys located on said base plate.

* * * * *